United States Patent [19]

Beyer et al.

[11] Patent Number: 4,924,749

[45] Date of Patent: May 15, 1990

[54] METHOD AND APPARATUS FOR STABILIZING HIGH-DYNAMICS DEVICES

[75] Inventors: Otto Beyer, Stuhr 2; Bertold Kirst, Lilienthal, both of Fed. Rep. of Germany

[73] Assignee: LITEF GmbH, Freiburg im Breisgau, Fed. Rep. of Germany

[21] Appl. No.: 6,001

[22] Filed: Jan. 21, 1987

[30] Foreign Application Priority Data

Jan. 24, 1986 [EP] European Pat. Off. ..... 86100960.3

[51] Int. Cl.[5] ..... F41G 5/16

[52] U.S. Cl. ..... 89/41.09; 235/407

[58] Field of Search ..... 89/41.09, 41.05, 41.06, 89/41.16, 41.17, 41.22; 364/423; 235/407; 33/236, 237

[56] References Cited

U.S. PATENT DOCUMENTS

| | | | |
|---|---|---|---|
| 3,803,387 | 4/1974 | Lackowski | 89/41.09 |
| 3,829,659 | 8/1974 | Margolis | 235/407 |
| 3,844,196 | 10/1974 | Taylor et al. | 89/41.09 |
| 3,984,748 | 10/1976 | Sullivan | 318/654 |
| 4,012,989 | 3/1977 | Hunt et al. | 33/236 |
| 4,265,111 | 5/1981 | Teiling . | |
| 4,480,524 | 11/1984 | Blomqvist et al. | 89/41.16 |
| 4,616,127 | 10/1986 | Whiting | 364/423 |
| 4,632,012 | 12/1986 | Feige et al. | 89/41.09 |

FOREIGN PATENT DOCUMENTS

| | | | |
|---|---|---|---|
| 159392 | 10/1985 | European Pat. Off. . | |
| 3229819 | 2/1984 | Fed. Rep. of Germany . | |
| 2353606 | 10/1985 | Fed. Rep. of Germany | 89/41.09 |
| 720080 | 12/1954 | United Kingdom | 89/41.09 |
| 2067789 | 7/1981 | United Kingdom . | |

OTHER PUBLICATIONS

Article by R. M. Ogorkiewicz, "Dispositifs de pointage stabilises pour canans de chars", in Revue International de Defense (10/13/86).

*Primary Examiner*—Charles T. Jordan
*Assistant Examiner*—Stephen Johnson
*Attorney, Agent, or Firm*—Elliott N. Kramsky

[57] ABSTRACT

A method and apparatus for stabilizing relatively high-dynamics devices (e.g. a sight) mounted on a low-dynamics support such as a tank. Movement of the low-dynamics support is determined by means of an inertial central sensor block that may comprise a strap-down set of gyros or gyros and accelerometers. Stabilization is achieved by a two-step process in which the individual high-dynamics devices are stabilized with respect to the support by means of large bandwidth control loops. The much slower support movement is applied to a superposed loop of appropriately smaller band-width. Compensation thereby takes place by specifying a reference value for the control loops of the higher-dynamics devices.

12 Claims, 2 Drawing Sheets

METHOD AND APPARATUS FOR STABILIZING HIGH-DYNAMICS DEVICES

BACKGROUND

1. Field of the Invention

The present invention relates to the stabilization of a higher-dynamics device mounted on a low-dynamics support such as a tank, ship or the like. More particularly the invention pertains to such stabilization in which movements of the low-dynamics support are detected by a central sensor block.

2. Description of the Prior Art

U.S. Pat. Ser. No. 4,632,012 of Feige et al., for "Fire Control System for Moving Weapon Carriers", property of the assignee herein, teaches a fire control and navigation system for movable weapon supports such as combat tanks. That system utilizes a single central strapdown sensor block for both primary stabilization of, for example, a sighting or visual device and secondary stabilization of a weapon.

The sensor block for the system includes a pair of double-axis, dry, dynamically tuned gyros and three single-axis accelerometers, the outputs of which are processed in digital format. This known system enables one to achieve exact firing control as well as dynamic weapon point stabilization.

In order to utilize the advantages of such a strapdown fire control and navigation system it is necessary to stabilize not only the weapon but also the line of sight by means of a central set of sensors. Thus, in a gunner's sighting device, for example, a relatively small deflecting mirror having substantially higher dynamics than its support (the tank) also requires stabilization.

By employing the approach of the Feige et al., patent, one would fit gyro measuring devices and accelerometers at the deflecting mirror. This would entail redesign of the inertial sensors and the digital data processing for the high bandwidth of the deflecting mirror. This approach thus imposes stringent requirements on both the dynamics of the sensor block as a whole and system bandwidth.

SUMMARY AND OBJECTS OF THE INVENTION

It is, therefore, an object of the invention to provide a method and apparatus for stabilizing the position in space of devices having relatively high dynamics that are mounted on low-dynamics supports.

Another object of the invention is to achieve the above object in a technically simple manner in a flexible system that permits adaptation to the type, number and individual dynamics of the individual devices.

It is yet another object of the invention to achieve the above objects in a system in which common inertial sensors are fitted to the support.

The present invention achieves the above and additional objects by providing, in a first aspect, a method for stabilizing relatively high dynamics devices mounted to a low dynamics support whose movement is controlled by a central sensor block comprising an inertial set of sensors engaged thereto. The method includes the step of providing, as the central sensor block, a set of gyros responsive to rotations about at least three independent axes. The bandwidths of the gyros are selected solely in accordance with the dynamics of the support. A closed control loop is provided whose bandwidth is selected in accordance with the dynamics of the device.

Thereafter, the setting of the device with respect to the support is determined along at least two axes by means of angle pickups. This is followed by applying the setting to the central loop so that the changes in setting determined by the central sensor block are superimposed as reference values upon the control loop.

In another aspect, the inertial sensor block includes not only a set of gyros, as above, but also a sufficient number of accelerometers to measure acceleration along three independent axes, such as is available in a strapdown system or analytical platform. Such a system can provide data concerning the position, speed, acceleration, setting, and change of setting relative to a navigation coordinate system related to the earth.

The foregoing features and advantages of this invention will become apparent from the detailed description that follows. This written description is accompanied by a set of drawing figures. Numerals of the drawing figures and the accompanying text point to the features of the invention, like numerals referring to like features throughout both the written description and the illustrations.

DETAILED DESCRIPTION

Figure 1:
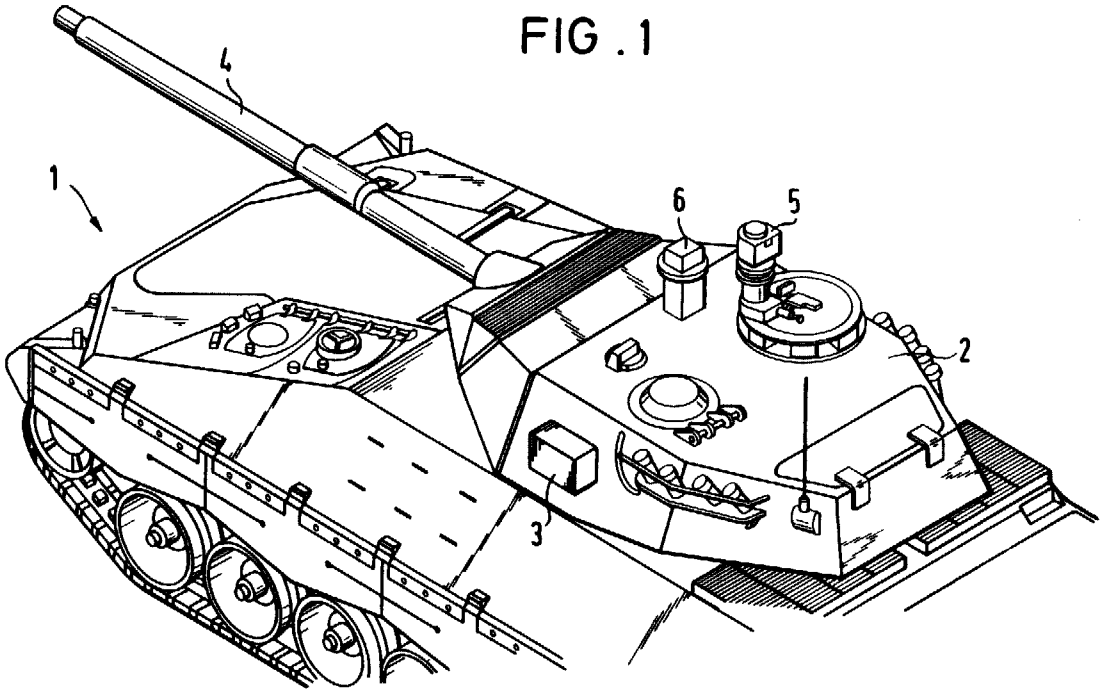
FIG. 1 is a top perspective view of a (low dynamics support) combat tank, equipped with a number of (high dynamics) sensors for stabilization in accordance with the invention.

FIG. 1 is a top perspective view of a combat tank 1 equipped with a number of high dynamics sensor devices requiring stabilization.

The tank 1, including a turret 2, functions as a relatively low-dynamics support. A number of devices requiring stabilization are mounted to the turret 2 including a gun 4 that functions as the main tank weapon, a (commander's) periscope 5 and a (gunner's) sighting device 6. A central sensor block 3, mounted as a complete unit in the turret 2, measures the comparatively slow turret movements relative to a navigation co-ordinate system that is fixed with respect to the earth.

Figure 2:
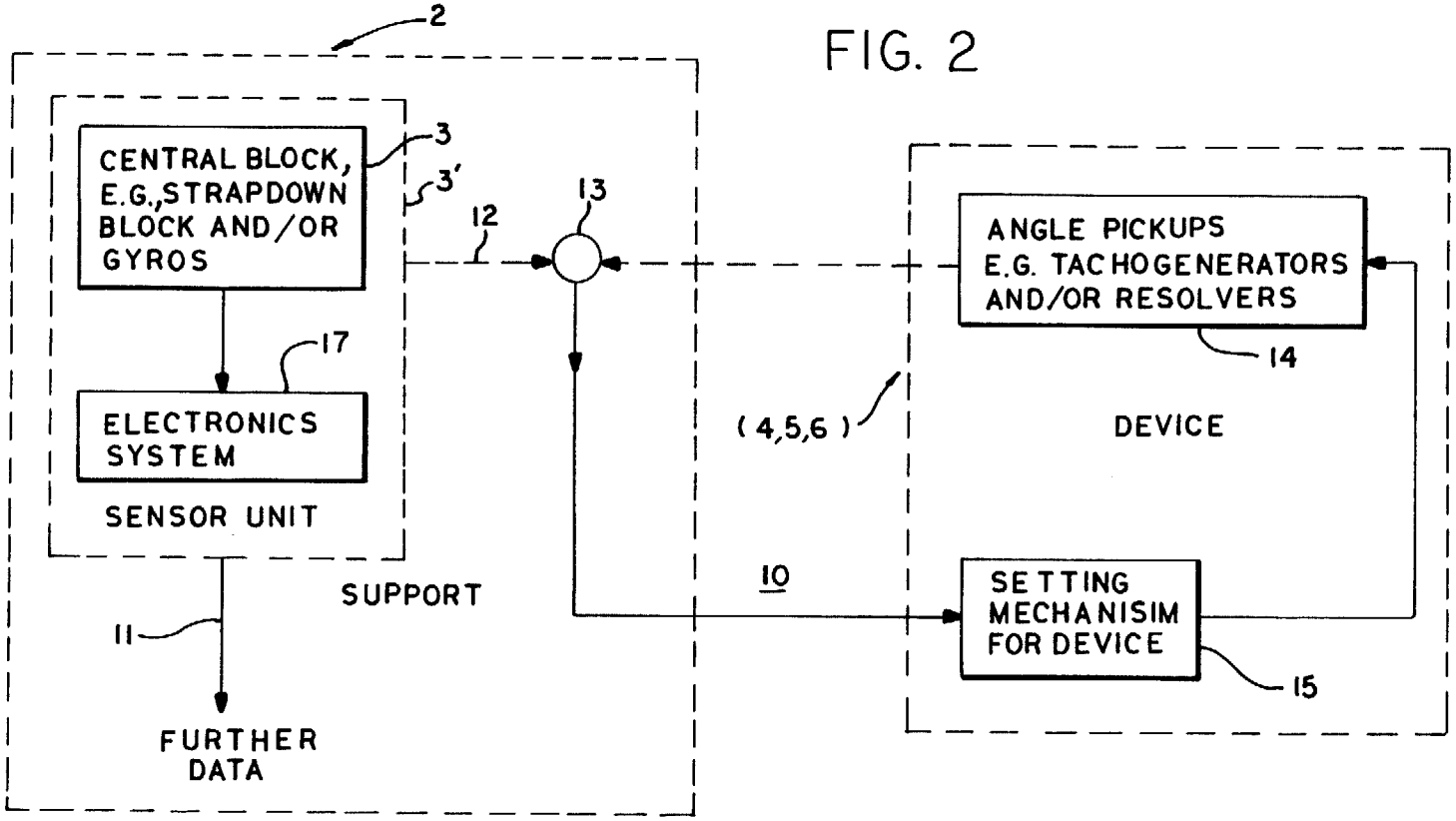
FIG. 2 is a block diagram of device stabilization apparatus in accordance with the invention.

FIG. 2 is a block diagram of device stabilization apparatus for utilization with a combat tank system in accordance with FIG. 1. As shown, the central sensor block 3 (e.g. a strapdown set) supplies the support (turret 2) setting and setting change data via a data line 12 to a junction point 13 of a closed control loop 10 that serves to stabilize one of the devices (4, 5 or 6) mounted in the turret 2. The support setting data supplied at the junction point 13 serve as an infraposed guide quantity or reference value in the control loop 10. The (relative) setting data of the control loop 10 (actual data) are supplied by angle pickups such as resolvers 14. The reference value that determines the setting of the support is superposed and supplied to one or more device control elements 15 at the junction point 13.

The operation of the invention is advantageously illustrated with reference to an example in which a mechanically rigid support is presumed. An armored combat vehicle or tank is assumed to be the support. Accordingly, the movably fitted devices include, for example, the gunner's main telescopic sight 6, the commander's periscope 5, and the main tank weapon 4.

Stabilization is required for the lines of sight of the gunner's and commander's sighting devices 6 and 5, respectively, as well as for the setting of the weapon 4. In accordance with prior stabilization methods, a pair of single-axis rate gyros with associated control systems is required per device. As such, stabilization (with respect to bearing and elevation) occurs separately for each device. Thus, the gyros and the control systems of the stabilized devices must, in each instance, exhibit a sufficiently wide bandwidth to detect fully and to stabilize the movements of those devices in space. For example, a known combat tank currently requires six single-axis rate gyros. This solution becomes particularly costly when several devices must be stabilized on a common support as a set of gyros is required for each device.

In contrast and as an improvement thereto (c.f. the system set forth in the above-mentioned patent, the method of this invention permits the mounting of a central sensor block at a protected position that is fixed in relation to the vehicle while, at the same time, permitting a simple method of stabilization of the higher-dynamics devices. A technical distinction exists between two cases, each set forth below.

FIRST CASE

The central sensor block consists of a single set of gyros. In this arrangement, the set of gyros includes a sufficient number of gyros to measure quantities with respect to three independent measurement axes. Thus, for example, when double-axis gyros are utilized, at least two are required, whereas, in the case of single-axis gyros, at least three gyros are necessary. In this case, the devices may only be stabilized with respect to inertial space. This is similar to the above-described prior art systems for combat tanks. However, only a single set of gyros is necessary for the stabilization of all of the high dynamics devices.

SECOND CASE

The inertial sensor block includes not only a set of gyros as in the prior case, but also a sufficient number of accelerometers to measure along three independent axes. Such a set of sensors is available, for example, in a strap-down system or analytical platform. That type of a system may provide data concerning the position, speed, acceleration, setting (and change of setting) of the support relative to a navigation co-ordinate system with respect to earth. Thus, in this case, device stabilization may be undertaken in relation to a navigation co-ordinate system with respect to the earth.

In both of the above-referenced cases, the inertial sensor block senses movements of the turret co-ordinate system. The outputs of the sensor block are utilized as reference values by the individual device stabilization control systems. Each device (e.g. weapon, visual device, sighting device or the like) is provided with its own control system having a device-specific bandwidth. The settings of the devices relative to the support (turret of the combat tank) are determined by angle pickups, the outputs of which control setting mechanisms (at the devices) by means of high bandwidth closed control loops. Accordingly, changes of setting and turret movements are utilized as guide quantities by the device control loops.

The inventors have found that the angles of disturbance that occur in a comparatively massive support (e.g. tank turret) decrease rapidly with increasing frequency. Indeed, to stabilize a tank's gun in accordance with the above-referenced patent requires a bandwidth that is approximately three times greater than the measured bandwidths of the angles of disturbance at the tank turret. The stabilization of line-of-sight devices can require regulating systems and sensors having bandwidths that are approximately fifteen times greater. The above findings are reasonable as a tank turret which weighs several tons moves with relatively great inertia. A lighter gun exhibits higher dynamics, and the relatively light deflecting mirrors of optical sighting devices (telescopic sight of the gunner, periscope of the commander) exhibit very high dynamics. The invention takes advantage of the foregoing by means of a two-step process wherein the individual high-dynamics devices are stabilized with the required large bandwidth with respect to the support and the lesser movement of the support determined and compensated by means of a superposed control loop of smaller bandwidth.

By employing the teachings of the invention, it is possible, by employing a conventional set of inertial sensors (e.g. strapdown system) on the support and angle pickups, or rotational speed pickups, such as tachogenerators, and angle measuring devices, such as resolvers, respectively at the devices, to stabilize the high-dynamics devices. In this regard, it is highly significant that the bandwidth of the set of inertial sensors need only be sufficiently large to permit accurately known movements of the low-dynamics support. This bandwidth is, in general, markedly smaller than those of the devices to be stabilized. When an analytical platform is employed for the set of inertial sensors, the platform invariably supplies the position and the setting of the support and quantities derived therefrom for additional functions, such as those utilized by a central firing control. The number of devices which may be stabilized and their bandwidths are in principle, unlimited. The method permits an optimum modular construction and is suitable for varying types of vehicles (regardless of the number of devices to be stabilized). For example, the gunner's sighting device requires the greatest stability in a combat tank. Therefore, the control systems and angle pickups for that device exhibit the greatest bandwidth. The other devices to be stabilized (e.g. commander's periscope, weapons) can then be equipped with control systems whose bandwidths are individually coordinated with the dynamics of those devices. In contrast to prior stabilization methods, especially those for use with combat tanks, the following advantages are achieved:

(First Case)

(a) Inertial sensors of the central sensor block (analytical platform) may be located at a protected unexposed position;
(b) Size and weight restrictions of the central sensor block are not applicable;
(c) The central sensor block is of standardized form, readily accessible and easily maintained;
(d) An arbitrary number of devices may be simultaneously stabilized by the inertial sensor block;
(e) The central sensor block, or more precisely, the electronics system (17) associated with it, can be constructed in digital technology, and requires only sufficient processing speed to correctly describe the movements of the support. At the same time, the device control systems may be constructed as rapid analog control systems, permitting a low cost solution by employing standard systems in the central sensor block;

(f) A set of high-quality gyros may be employed in the inertial sensor block. A higher degree of system reliability and availability is achieved since strapdown gyros have a markedly greater service life than the rate gyros which are customarily employed for armored weapons stabilization; and (g) Navigation quality strapdown gyros exhibit lower drift (by a number of orders of magnitude) than conventional rate gyros. Accordingly, high accuracy of navigation data is obtained.

(Second Case)

When an inertial sensor block with accelerometers (e.g. strapdown system) is employed, additional advantages are achieved:

(h) The earth's rotation is taken into consideration and compensated during stabilization as stabilization is undertaken with respect to a coordinate system that is fixed with respect to earth. As a result, the observation and monitoring of portions of terrain by optical sighting systems are enhanced;

(i) The speed of the support can be compensated, resulting in a drift-free image (even during travel) when an observation or sighting device, for example, is stabilized in accordance with the invention;

(j) Three-axis stabilization may be accomplished without additional inertial sensors. As a result, image rotation about the support tilt axis is prevented, permitting steady image presentation on viewing devices;

(k) The vertical sensor formerly required to compensate tilt angle is dispensed with, as its function is carried out by the central sensor block.

As the invention is based upon the application of an inertial central sensor system including accelerometers, data are provided with respect to the location, setting and movement of the support. As a result, additional useful functions may be performed in an armored vehicle. As the central sensor block (analytical platform) supplies the position of the vehicle with respect to a navigation system that is fixed in relation to the earth, the vehicle's orientation in unknown terrain, poor visibility or other difficult environmental conditions is facilitated. Moreover, the strapdown system supplies data concerning the speed and angular velocity of the turret for improved firing control as, for example, correction of the muzzle velocity of the projectile of the gun 4. All data are made available via the data bus 12. Furthermore, with the aid of range-finding measurements from the armored vehicle to the target, point stabilization dynamic aiming-off allowance computations can be performed with accuracy.

While this invention has been described with reference to its presently preferred embodiment, it is by no means limited thereto. Rather, its scope is limited only insofar as defined by the set of claims which follows and it includes all equivalents thereof.

What is claimed is:

1. Apparatus for the stabilization of a device which is movably mounted on a support, said device having, in comparison with the support, a high speed of response to deviations from a rest position, comprising:

(a) a control loop, said loop including a setting mechanism, associated with the device for control of deviations of the device from the rest position, said control loop having a bandwidth matched to the speed of response of the device, said setting mechanism being operably responsive to an input of a regulating quantity;

(b) a plurality of angle pickups in the control loop for detecting a position of the device relative to the support with respect to at least two axes and for generating output signals corresponding to that relative position;

(c) a sensor unit including a central sensor block mounted on the support and equipped with inertial sensors which have bandwidths matched to a relatively slow speed of response of the support, the sensor unit being capable of detecting changes of position of the support in an inertial system with respect to at least three measurement axes and of generating output signals corresponding to the position of the support in the inertial system; and (d) means in the control loop for superposing the output signals of the sensor unit onto the output signals of the angle pickups to produce resulting signals such that the former serves as a reference or guide quantity on the latter, and for feeding the resulting signals to the setting mechanism as the regulating quantity.

2. Apparatus as defined in claim 1, wherein said central sensor block is a strapdown system.

3. Apparatus as defined in claim 1, wherein said device is equipped with three angle pickups for a determination of its setting relative to the support along three mutually orthogonal axes.

4. Apparatus as defined in claim 1, wherein resolvers are employed as the angle pickups.

5. Apparatus as defined in claim 1, wherein tachogenerators for measurement of speeds of rotation are employed as signal sources of the angle pickups.

6. Apparatus as defined in claim 1, wherein the control loop is an analog loop, and wherein the central sensor block has an electronics system associated with it which is constructed in digital technology.

7. Apparatus as defined in claim 1, wherein the support is a tank, and wherein the device is a gun.

8. Apparatus as defined in claim 7, wherein measured values required for compensation of ballistic disturbances on discharge of a projectile from the tank are determined by the central sensor block and made available thereby for fire control computation.

9. Apparatus as defined in claim 7, wherein measured values required for dynamic aiming-off allowance computation are determined by the central sensor block and made available thereby for fire control computation.

10. Apparatus as defined in claim 1, wherein the device is a periscope.

11. Apparatus as defined in claim 1 wherein the device is a sighting device.

12. Apparatus as defined in claim 1, wherein the central sensor block has an electronic system associated with it which is constructed in digital technology, and wherein the electronic system is capable of performing any navigation computations required for the determination of the position of the support.

* * * * *